US009116476B2

(12) United States Patent
Takahashi et al.

(10) Patent No.: US 9,116,476 B2
(45) Date of Patent: Aug. 25, 2015

(54) FIXING DEVICE AND IMAGE FORMING APPARATUS

(75) Inventors: Yoshiharu Takahashi, Osaka (JP); Chikara Hiraoka, Osaka (JP); Tamotsu Ikeda, Osaka (JP); Kohta Sakaya, Hyogo (JP); Yoshihiro Kawakami, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 104 days.

(21) Appl. No.: 13/338,765

(22) Filed: Dec. 28, 2011

(65) Prior Publication Data

US 2012/0195652 A1 Aug. 2, 2012

(30) Foreign Application Priority Data

Jan. 27, 2011 (JP) ..... 2011-015230

(51) Int. Cl.
*G03G 15/20* (2006.01)

(52) U.S. Cl.
CPC ..... *G03G 15/2028* (2013.01)

(58) Field of Classification Search
USPC ..... 399/322, 122, 398, 399; 271/307, 308, 271/311, 900
See application file for complete search history.

(56) References Cited

U.S. PATENT DOCUMENTS 6,085,064 A * 7/2000 Nagase et al. ..... 399/399
6,205,316 B1 * 3/2001 Iida ..... 399/323
6,650,862 B2 * 11/2003 Nakano et al. ..... 399/323
7,424,263 B2 9/2008 Shimizu et al.
7,429,995 B2 * 9/2008 Sato et al. ..... 347/156
7,496,326 B2 * 2/2009 Kawabata ..... 399/399
7,623,821 B2 11/2009 Kubota et al.

(Continued)

FOREIGN PATENT DOCUMENTS

JP 2003-270995 A 9/2003
JP 2004-61854 2/2004

(Continued)

OTHER PUBLICATIONS

Office Action and Search Report issued on Jan. 15, 2014 in the corresponding Chinese Patent Application No. 201210019287.3 (with Category of Cited Documents in the attached Foreign Language Search Report).

(Continued)

*Primary Examiner* — Clayton E Laballe
*Assistant Examiner* — Victor Verbitsky
(74) *Attorney, Agent, or Firm* — Oblon, McClelland, Maier & Neustadt, L.L.P.

(57) ABSTRACT

A fixing device, including a fixing member; an opposing member contacting the fixing member to form a fixing nip; plural separation assisting members; a contact direction biasing member contacting an end of the auxiliary separation members to the surface of the fixing member; a contact and release switching member switching contacting the end of the auxiliary separation members to the surface of the fixing member and releasing the end of the auxiliary separation members therefrom; a fixing exit guide member guiding a recording medium to a discharge direction and separated from the fixing member by the separation assisting member; a first rotating member near the auxiliary separation members downstream from an end thereof; and a second rotating member guiding a recording medium guided by the fixing exit guide member in the recording medium conveyance direction while rotating.

17 Claims, 12 Drawing Sheets

(56) References Cited

U.S. PATENT DOCUMENTS

| | | | | |
|---|---|---|---|---|
| 7,706,724 | B2 | 4/2010 | Kawakami et al. | |
| 7,873,302 | B2 | 1/2011 | Kawakami et al. | |
| 7,890,044 | B2 | 2/2011 | Shimizu et al. | |
| 7,917,077 | B2 | 3/2011 | Shimizu et al. | |
| 7,945,203 | B2 | 5/2011 | Shimizu et al. | |
| 7,965,957 | B2 | 6/2011 | Kubota et al. | |
| 7,965,958 | B2 | 6/2011 | Tatsumi et al. | |
| 7,979,013 | B2 | 7/2011 | Yoshida et al. | |
| 8,019,254 | B2 | 9/2011 | Tatsumi et al. | |
| 8,081,897 | B2 | 12/2011 | Kubota et al. | |
| 2002/0098018 | A1* | 7/2002 | Kamiya | 399/323 |
| 2006/0132574 | A1 | 6/2006 | Kawabata | |
| 2008/0095559 | A1 | 4/2008 | Shimizu et al. | |
| 2008/0145119 | A1 | 6/2008 | Tatsumi et al. | |
| 2008/0205930 | A1 | 8/2008 | Kawakami et al. | |
| 2008/0219698 | A1 | 9/2008 | Shimizu et al. | |
| 2008/0267661 | A1 | 10/2008 | Yoshida et al. | |
| 2009/0022531 | A1 | 1/2009 | Kubota et al. | |
| 2009/0110449 | A1 | 4/2009 | Saito et al. | |
| 2009/0129836 | A1 | 5/2009 | Sakaya et al. | |
| 2009/0162101 | A1 | 6/2009 | Yoshida et al. | |
| 2009/0169246 | A1 | 7/2009 | Ooyoshi et al. | |
| 2009/0169265 | A1 | 7/2009 | Yoshida et al. | |
| 2009/0190949 | A1 | 7/2009 | Hamahashi et al. | |
| 2009/0238585 | A1 | 9/2009 | Hayashi et al. | |
| 2010/0028045 | A1 | 2/2010 | Kawakami et al. | |
| 2010/0034548 | A1 | 2/2010 | Naitoh et al. | |
| 2010/0086334 | A1* | 4/2010 | Sakaya | 399/328 |
| 2010/0239297 | A1 | 9/2010 | Sakaya et al. | |
| 2010/0260524 | A1 | 10/2010 | Hiraoka et al. | |
| 2011/0188874 | A1 | 8/2011 | Takahashi et al. | |
| 2011/0188896 | A1 | 8/2011 | Sakaya et al. | |
| 2011/0194864 | A1 | 8/2011 | Nakatake et al. | |
| 2011/0217055 | A1 | 9/2011 | Takehara et al. | |
| 2012/0045241 | A1 | 2/2012 | Takahashi et al. | |

FOREIGN PATENT DOCUMENTS

| | | | |
|---|---|---|---|
| JP | 2007-039151 | A | 2/2007 |
| JP | 2010-026379 | A | 2/2010 |
| JP | 2011-48351 | | 3/2011 |

OTHER PUBLICATIONS

Office Action issued Jun. 10, 2014 in Japanese Patent Application No. 2011-015230.

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2011-015230, filed on Jan. 27, 2011 in the Japanese Patent Office, the entire disclosure of which is hereby incorporated by reference herein.

FIELD OF THE INVENTION

The present invention relates to a fixing device fixing a developer on a recording medium and an image forming apparatus using the fixing device.

BACKGROUND OF THE INVENTION

Certain image forming apparatuses such as copiers, printers, facsimiles and multifunction machines combining several of these features use a pressing and heating fixing device for fixing an image (a toner image) developed with toner as developer on recording media such as paper. The fixing device typically includes a fixing roller heated by a heater, such as a halogen heater, and a pressure roller contacting the fixing roller to form a fixing nip through which the recording medium is conveyed.

When a toner image is fixed on a recording medium, a recording medium bearing a toner image is passed through a fixing nip to be heated and pressed, and the toner image is melted with heat and fixed on the recording medium. However, the melted toner occasionally causes the recording medium to adhere to the surface of the fixing roller and not separate cleanly from the fixing nip.

To solve this problem, a auxiliary separation member such as a separation click contacting its tip to the fixing roller is provided near the exit of the nip area, and has a role of guiding a recording medium separated from the fixing roller in a feed route of the recording medium as well. However, for that reason, an image formed on a recording medium is occasionally scratched by the separation click. Therefore, it is already disclosed that a guide member is disposed near the tip of the separation click such that a recording medium separated from the fixing roller by the separation click is passed to the guide member to guide the recording medium downstream.

Japanese published unexamined application No. 2004-061854 (JP-2004-061854-A) discloses a fixing device including a separation click contacting a fixing roller, a separation click protection member protecting the contact the separation click everywhere except where the click contacts the fixing roller, and a skid projecting beyond the separation click protection member so as prevent the separation click from scratching the images on the recording media.

In JP-2004-061854-A, a recording medium separated from the fixing roller by the separation click is conveyed to a guide member located close to the tip of the separation click. Since the recording medium bearing a toner image is still hot from the passage through the heated fixing nip when guided and discharged by the separation click and the guide member while contacting thereto, i.e., the toner image is not completely fixed, the resultant image has scratches or glossy stripes therein made by the separation click and the guide member.

Further, when a hard recording medium is discharged while pressed by the skid formed on the separation click protection member, although the recording medium is guided by the skid rotatably formed thereon, the skid does not solve the problems of production of defective images such as scratched images because the toner image that emerges from the fixing nip is not yet completely fixed on the recording medium.

SUMMARY OF THE INVENTION

Accordingly an object of the present invention is to provide a fixing device for an image forming apparatus which does not produce defective images having glossy stripes or scratches made by a separation click and a guide member even when a recording medium is guided and discharged by a separation click and a guide member while contacting thereto.

Another object of the present invention is to provide an image forming apparatus using the fixing device These objects and other objects of the present invention, either individually or collectively, have been satisfied by the discovery of a fixing device, comprising:

a rotatable or turnable fixing member comprising a heat source;

an opposing member configured to contact the fixing member to form a fixing nip where a toner image is fixed on a recording medium therebetween;

plural auxiliary separation members in an axial direction of the fixing member, contactable thereto and releasable therefrom, configured to separate the recording medium having passed the fixing nip;

a contact direction biasing member configured to contact an end of the auxiliary separation members to the surface of the fixing member; and a contact and release switching member configured to switch contacting the end of the auxiliary separation members to the surface of the fixing member and releasing the end of the auxiliary separation members therefrom, wherein the fixing device further comprises:

a fixing exit guide member located downstream from the fixing nip in a recording medium conveyance direction and configured to guide a recording medium to a discharge direction having passed the fixing nip and separated from the fixing member by the separation assisting member;

a first rotating member rotatably held by a holding member of the auxiliary separation members near the auxiliary separation members downstream from an end thereof in the recording medium feeding direction; and a second rotating member rotatably held by the fixing exit guide member downstream from the first rotating member in the recording medium conveyance direction and configured to guide a recording medium guided by the fixing exit guide member in the recording medium conveyance direction while rotating.

These and other objects, features and advantages of the present invention will become apparent upon consideration of the following description of the preferred embodiments of the present invention taken in conjunction with the accompanying drawings.

BRIEF DESCRIPTION OF THE DRAWINGS

FIG. 14 is a perspective view illustrating a guide roller of the fixing device in

FIG. 13.

DETAILED DESCRIPTION OF THE INVENTION

Figure 1:
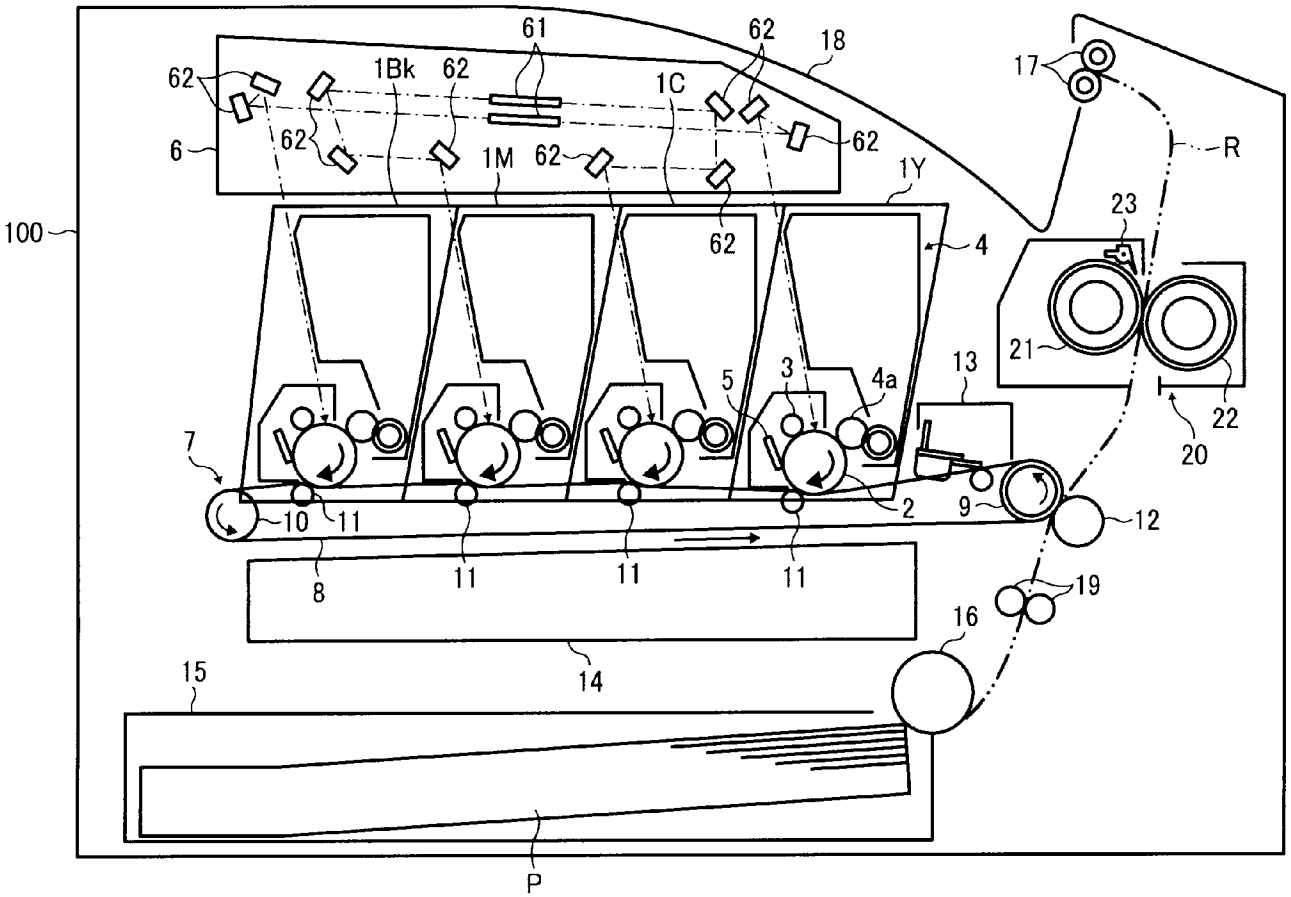
FIG. 1 is a schematic view illustrating an embodiment of the image forming apparatus of the present invention.

FIG. 1 is a schematic view illustrating an embodiment of the image forming apparatus of the present invention.

Hereinafter, a recording medium and a recording medium conveyance direction are referred to as a "recording paper" and a "recording paper feeding direction", respectively. The recording medium is not limited a paper, and includes a variety of media which are sheet or film-shaped members electrophotographic images are formable on such as resins, clothes and leathers.

The image forming apparatus in FIG. 1 is an electrophotographic full-color image forming apparatus, including four process units 1Y, 1C, 1M and 1Bk detachable from a main body of the image forming apparatus 100. The process units 1Y, 1C, 1M and 1Bk have the same constitutions except for including color toners different from each other, i.e., a yellow toner, a cyan toner, a magenta toner and a black toner in respective image developers 4.

Specifically, each of the process units 1Y, 1C, 1M and 1Bk includes a photoreceptor drum 2 as a photoreceptor (latent image bearer), a charging roller 3 as a charger charging the surface of the photoreceptor drum 2, an image developer 4 as an image developing means providing a toner (developer) to the surface of the photoreceptor drum 2 and a cleaning blade 5 as a cleaner cleaning the surface of the photoreceptor drum 2. In FIG. 1, only the photoreceptor drum 2, the charging roller 3, the image developer 4 including a developing roller 4*a* and the cleaning blade 5 included in the yellow process unit 1Y have signs. In the other process units 1C, 1M and 1Bk, the signs are omitted.

In FIG. 1, above each of the process units 1Y, 1C, 1M and 1Bk, an irradiator 6 is located as an irradiating means (latent image forming means) irradiating the surface of the photoreceptor drum 2. The irradiator 6 reflects laser beams from unillustrated plural laser beam sources with a double-deck polygon mirror 61 and multiple mirrors 62 to emit four laser beams irradiating the surface of the photoreceptor drum 2 in each of the process units 1Y, 1C, 1M and 1Bk.

Meanwhile, below each of the process units 1Y, 1C, 1M and 1Bk, a transferer 7 is located. The transferer 7 has an intermediate transfer belt 8 formed of an endless belt as a transfer body. The intermediate transfer belt 8 is tightly wound around a drive roller 9 and a driven roller 10 and rotatable in an arrow direction.

Four first transfer rollers 11 are located facing the four photoreceptor drums 2 of the process units 1Y, 1C, 1M and 1Bk. Each of the first transfer rollers 11 presses an inner circumferential surface of the intermediate transfer belt 8 at each of their positions, and a first transfer nip is formed at a position where a part of the intermediate transfer belt 8 which is pressed and the photoreceptor drum 2 contact each other. A second transfer roller 12 as a second transfer means is located facing the drive roller 9. The second transfer roller 12 presses an outer circumferential surface of the intermediate transfer belt 8, and a second transfer nip is formed at a position where the second transfer roller 12 and the intermediate transfer belt 8 contact each other.

On an outer circumferential surface of the intermediate transfer belt 8 at the right side in FIG. 1, a belt cleaner 13 cleaning the surface of the intermediate transfer belt 8 is located. An unillustrated waste toner transfer hose extending from the belt cleaner 13 is connected to an entrance of a waste toner container 14 located under the transferer 7. The main body of the image forming apparatus 100 includes a paper tray 15 containing a recording paper P as a recording medium, a paper feed roller 16 feeding the recording paper P from the paper tray 15, etc. at the bottom. In addition, the main body of the image forming apparatus 100 includes a pair of paper discharge rollers 17 discharging a recording paper out and a discharged paper tray 18 stocking the discharged recording paper at the top.

Further, the main body of the image forming apparatus 100 includes a feed route R guiding a recording paper from the paper tray 15 at the bottom to the discharged paper tray 18 at the top. In the feed route R, a pair of registration rollers 19 are located on the way from the paper feed roller 16 to the second transfer roller 12. A fixing device 20 fixing an image on a recording paper is located on the way from the second transfer roller 12 to the pair of paper discharge rollers 17.

The fixing device 20 includes a fixing roller 21 as a fixing rotor which is a fixing member heated by a heat source, a pressure roller 22 as a pressure rotor which is an opposite member contacting the fixing roller 21 to form a fixing nip, a separation click 23 as a separation assisting member separating a recording paper from the fixing roller 21, etc.

In the fixing device 20, an unillustrated pressurizer contacts the rotatable fixing roller 21 and the pressure roller 22 to each other with pressure to form a nip at a contact point, but the configuration is not limited to this. For example, at least either of the fixing member or the opposite member may be a turnable endless belt, and a roller or a pad may contact the belt to the other with pressure. In addition, the fixing member and the opposite member may contact each other without pressure.

A basic operation of the image forming apparatus is explained, referring to FIG. 1.

When an image forming operation is starts, the photoreceptor drum 2 of each of the process units 1Y, 1C, 1M and 1Bk is driven to rotate clockwise in an arrow direction in FIG. 1, and the surface of each of the photoreceptor drums 2 is uniformly charged to have a predetermined polarity by the charging roller 3. The charged surface of the photoreceptor drum 2 is irradiated with a laser beam from the irradiator 6 and an electrostatic latent image having each color component is formed on the surface of each of the photoreceptor drums 2.

Image information irradiated to each of the photoreceptor drums 2 is each of monochrome yellow, cyan, magenta and black image information resolved from a desired full-color image. Each color toner is provided to the electrostatic latent image formed on each of the photoreceptor drums 2 by each of the image developers 4 to visualize the electrostatic latent image as a toner (developer) image of each color.

The drive roller 9 is rotationally driven anticlockwise in an arrow direction in FIG. 1 to drive the intermediate transfer belt 8 to run in an arrow direction. Each of the first transfer rollers 11 is applied with a constant-voltage or a constant-current controlled voltage having a polarity reverse to a charged toner polarity.

Thus, a transfer electric field is formed at the first transfer nip between each of the first transfer rollers 11 and each of the photoreceptor drums 2. The toner image of each color formed on the photoreceptor drum 2 of each of the process units 1Y, 1C, 1M and 1Bk is sequentially transferred and overlapped on the intermediate transfer belt 8 by the transfer electric field is formed at the first transfer nip. Then, the intermediate transfer belt 8 bears a full-color toner image on its surface.

A residual toner adhering to the surface of each of the photoreceptor drums 2 after a toner image is transferred is removed by the cleaning blade 5, and the surface is discharged by an unillustrated discharger and a potential thereof is initialized to be ready for the following image formation.

When an image formation is started, at the bottom of the image forming apparatus, the paper feed roller 16 rotationally drives to feed a recording paper P contained in the paper tray 15 to the fed route R. A recording paper P fed to the fed route R is fed to the second transfer nip in synchronized timing by the registration roller 19 between the second transfer roller 12 and the drive roller 9 opposite thereto. The second transfer roller 12 is applied with a transfer voltage having a polarity reverse to a charged toner polarity on the intermediate transfer belt 8 to form a transfer electric field at the second transfer nip.

A toner image on the intermediate transfer belt 8 is transferred onto a recording medium P by the transfer electric field formed at the second transfer nip. A recording medium P a toner image is transferred on is fed to the fixing device 20, and the recording medium P is heated and pressurized by the fixing roller 21 and the pressure roller 22 to fix the toner image. A recording medium P a toner image is fixed on is separated from the fixing roller 21 by the separation click 23 and discharged by the paper discharge roller 17 to the discharged paper tray 18. A residual toner on the intermediate transfer belt 8 after transferred is removed by the belt cleaner 13, and the removed toner is fed to and collected in the waste toner container 14.

So far, full-color image formation on a recording paper has been explained. Any one of the process units 1Y, 1C, 1M and 1Bk may be used to form a monochrome image, or two or three process units may be used to form two- or three-color images.

Figure 2:
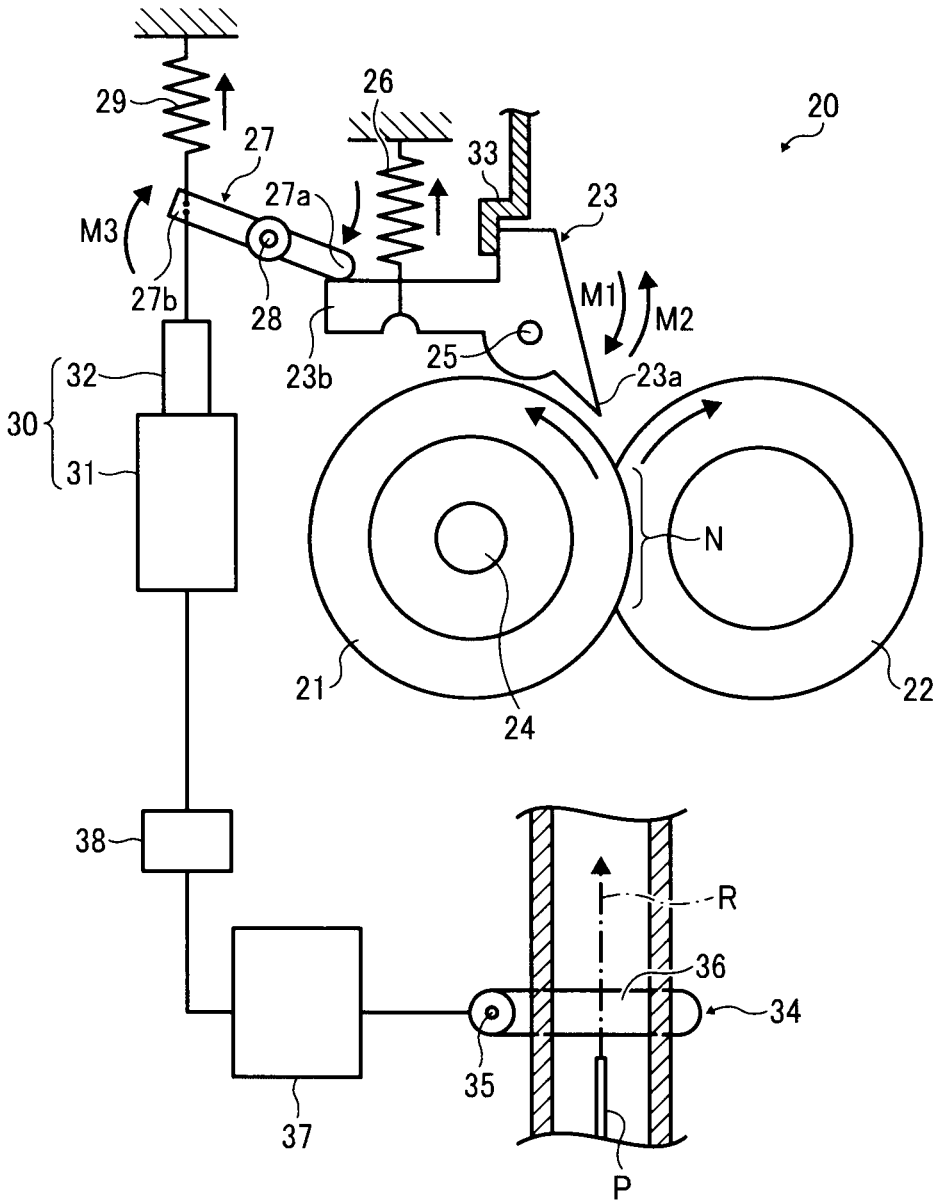
FIG. 2 is a schematic view showing a separation click of a fixing device does not contact a fixing roller in FIG. 1.
Figure 3:
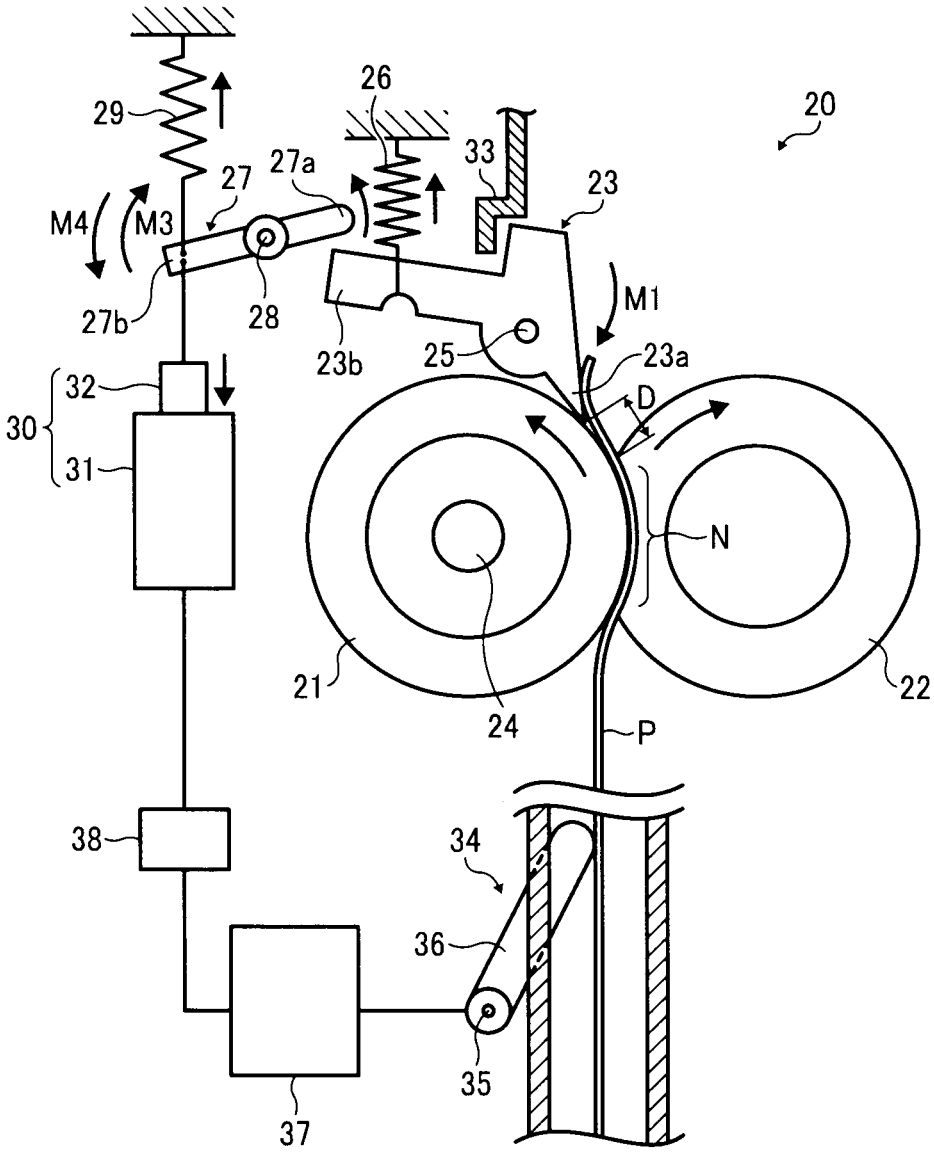
FIG. 3 is a schematic view showing the separation click of the fixing device contacts the fixing roller in FIG. 1.

FIGS. 2 and 3 are schematic views for explaining contact and separation operation of the separation click in the fixing device.

As these Figs. show, the fixing device 20 includes the fixing roller 21 and the pressure roller 22 contacting each other to form a fixing nip N fixing a toner image on a recording paper P. The fixing roller 21 includes the heat source 24 heating the fixing roller 21. The fixing roller 21 and the pressure roller 22 are rotated in arrow directions in Figs., respectively.

The fixing roller 21 is a fixing rotor as a fixing member, and a cylindrical member including a thermally-conductive substrate, an elastic layer overlying the substrate and a coated layer overlying the elastic layer. Carbon steels or aluminum having desired mechanical strength and good thermal conductivity is mostly used as the thermally-conductive substrate. The elastic layer is formed of synthetic rubbers such as silicone rubbers or fluorine-containing rubbers.

The coated layer on the elastic layer is formed of a material having high thermal conductivity and durability because of improving releasability from a toner and increase durability of the elastic layer. For example, PFA tubes, PFA or PTFE coatings, silicone rubbers, or fluorine-containing rubbers may be used as the coated layer.

The pressure roller 22 is a pressure rotor as an opposite member, and a cylindrical member including a core metal, an elastic layer overlying the core metal and a coated layer overlying the elastic layer. As the core metal, e.g., carbon steels for mechanical structures (STKM) are used, and silicone rubbers, fluorine-containing rubbers or their foamed bodies are used as the elastic layer. The coated layer is formed of tubes of heat resistant fluorine contained resins such as PFA and PTFE having high releasability.

Around the fixing roller 21, an unillustrated thermistor as a thermal detector and a thermostat preventing abnormal temperatures are located. A detection signal from the thermistor controls a surface temperature of the fixing roller 21 to be kept in a predetermined temperature range.

The separation click 23 as a separation assisting member is located opposite to the fixing roller 21 downstream from the fixing nip N in a recording paper feeding direction. Four separation clicks 23 are located at equal intervals along an axial direction of the fixing roller 21. The number of the separation click 23 has only to be plural, and is not limited to 4.

Each of the separation clicks 23 is independently and turnably supported by an unillustrated holding member around a support axis 25. When each of the separation clicks 23 turns around the support axis 25 clockwise or anticlockwise in FIG. 2 or 3, an end 23*a* of each of the separation clicks 23 independently closes to and separates from the fixing roller 21. FIG. 2 shows the separation click 23 separates from the fixing roller 21, and FIG. 3 shows the separation click 23 contacts the fixing roller.

As materials for the separation click 23, materials having good releasability and slidability such as PFA, polyetherketone (PEK) and polyetheretherketone (PEEK) are mostly used. Alternatively, the surface of the separation click 23 may be coated with materials having good releasability and slidability such as PFA and TEFLON (registered trademark of DuPont).

A tension coil spring 26 is located at another end 23*b* opposite to the end 23*a* of each of the separation clicks 23. This fixing device uses the tension coil spring 26 as a contact direction biasing means, but may use other biasing means according to conditions such as setting space and production cost. The separation click 23 is biased by the tension coil spring 26 in a direction of contacting the fixing roller 21.

In addition, a contact releasing member 27 releasing contact of each of the separation clicks 23 to the fixing roller 21 is located at the end 23*b* of each of the separation clicks 23. The contact releasing member 27 is a lever turnably supported around a support axis 28. When the contact releasing member 27 turns around the support axis 28 clockwise or anticlockwise in FIG. 2 or 3, an end 27*a* of the contact releasing member 27 closes to and separates from the end 23*b* of the separation click 23. The contact releasing member 27 extends in a direction parallel to an axial direction of the fixing roller 21 to be contactable with all of the plural separation clicks 23.

As materials for the contact releasing member 27, resins having good heat resistance and abrasion resistance such as PPS and PEK which are light and have desired mechanical strength can be used. In order to prevent the contact releasing member 27 from deflecting in its axial (longitudinal) direction, particularly the support axis 28 is separately formed of stainless steel (SUS), but the material is preferably selected according to a size of the apparatus and biasing force to the separation click 23.

As an unillustrated link drivably connected with the contact releasing member 27, a tension coil spring 29 as a biasing means in a contact release direction biasing the contact releasing member 27 so as to separate the separation click 23 from the fixing roller 21 (in FIGS. 2 and 3, an end of the tension coil spring 29 is attached to another end 27*b* of the contact releasing member 27). When the end 27*b* of the contact releasing member 27 is pulled by the tension coil spring 29, the 27*a* of the contact releasing member 27 is biased in a direction of contacting the end 23*b* of the separation click 23 as FIG. 2 shows. Other biasing means can be used as the biasing means in a contact release direction according to conditions such as setting space and production cost.

A solenoid 30 is located as a drive means driving the contact releasing member 27. The solenoid 30 is formed of a solenoid main body 31 including a coil and a reciprocable plunger 32 reciprocable in the coil of the solenoid main body 31. The reciprocable plunger 32 is connected with an unillustrated link connected with the contact releasing member 27 (in FIGS. 2 and 3, the plunger 32 is connected with the end 27*b* of the contact releasing member 27).

When the coil in the solenoid main body 31 is excited and the plunger 32 is suctioned and retracted in the solenoid main body 31, the end 27*b* of the contact releasing member 27 is pulled and the contact releasing member 27 is turned against a biasing force of the tension coil spring 29 as FIG. 3 shows.

Above each of the separation clicks 23 in FIGS. 2 and 3, a position determining means 33 holding the end 23*a* of each of the separation clicks 23 at a predetermined separate position from the fixing roller 21 is located.

A recording paper detection means 34 is located at an upstream side (below in FIG. 2 or 3) of the fixing nip N in a recording paper feeding direction. The recording paper detection means 34 has a detector 36 oscillatable or turnable around a support axis 35. Typically, the detector 36 is located at a position where a recording paper P intersects with the feed route R as FIG. 2 shows. When a recording paper P contacts the detector 36, the detector 36 oscillates as FIG. 3 shows to detect the recording paper P.

After a recording paper passes, the detector returns to the original position by its own weight or a biasing means such as unillustrated return coil springs and contacts the unillustrated position determining part and held at a predetermined position in FIG. 2. the detector 36 is preferably located near the center of the feed route R in its width direction such that the feed route has a skew when a recording paper P contacts the detector 36. The detector 36 can feed a recording paper p in a correct form and secure feed reliability, preventing image distortion and paper wrinkles.

A non-contact paper detection means detecting a recording paper without contacting the recording paper can also be used as the paper detection means 34, not a contact detection means detecting a recording paper by contacting a recording paper. As the non-contact paper detection means, e.g., a reflection or a transmission optical sensor can be used. The non-contact paper detection means is free from a skew of the feeding form of a recording paper P.

Alternatively, when a blocking detection means detecting blocking of a recording paper is located at an upstream side of the fixing nip in a recording paper feeding direction, the blocking detection means can be used as the paper detection means 34 as well.

The solenoid 30 is driven, based on a detection signal from the paper detection means 34. Specifically, the solenoid 30 and the paper detection means 34 are electrically connected with each other through a controller 37 and a drive circuit 38. The controller 37 has a CPU including an I/O port. When a recording paper P is detected by the paper detection means 34, the controller 37 transmits a signal to the drive circuit 38 based on the detection signal to drive the solenoid 30.

The contact releasing member 27, the tension coil spring 29 as a biasing means in a contact release direction, the solenoid 30 and unillustrated link form a "contact and release switching member" switching contact to and release to the end 23*a* of the separation click 23 as a separation assisting member from the surface of the fixing roller 21. The paper detection means 34, the controller 37 and the drive circuit 38 form a drive control means for the contact and release switching member.

FIG. 2 shows the separation click does not contact the fixing roller. The separation click 23 receives a rotational moment M1 in a direction for the end 23*a* to close to the fixing roller 21 from the tension coil spring 26. On the other hand, the separation click 23 receives a rotational moment M2 having a direction reverse to that of M1 and larger than M1 from the tension coil spring 29. Therefore, the separation click 23 is separate from the surface of the fixing roller 21 because M2 is larger than M1.

FIG. 3 shows the separation click of the fixing device contacts the fixing roller. A predetermined drive current is applied to the solenoid 30 to suction the plunger 32. A rotational moment M4 of the plunger 32 to the contact releasing member 27 neutralizes a rotational moment M3 of the tension coil spring 29 to the contact releasing member 27 and which turns anticlockwise around the support axis 28. At the same time, a biasing force of the tension coil spring 26 turns the separation click 23 anticlockwise, and its end 23*a* contacts the surface of the fixing roller 21.

Then, the contact releasing member 27 further turns anticlockwise and stands still completely separate from the separation click 23. The end of 23*a* of the separation click 23 can follow the surface of the fixing roller 21 at a proper contact pressure only by the biasing force of the tension coil spring 26.

Then, when a current applied to the solenoid 30 is blocked and a suction power of the plunger 32 is released, a tension of the tension coil spring 29 is activated again and turns the contact releasing member 27 clockwise against the biasing force of the tension coil spring 26. The end 27*a* of the contact releasing member 27 contacts the end 23*b* of the separation click 23 to be turned anticlockwise, and the end 23*a* thereof separates from the surface of the fixing roller 21, which is the original status in FIG. 2.

In FIG. 3, a distance D from an exit of the fixing nip N (downstream end in a recording medium feeding direction) to a contact point of the end of 23*a* of the separation click 23 to the fixing roller 21 is preferably from 5 to 6 mm. When the distance D is determined such that the end of 23*a* of the separation click 23 contacts the surface of the fixing roller 21 at a position where a recording paper P is most separate from the surface of the fixing roller 21, seeing movement of the recording paper P discharged from the exit of the fixing nip, the separation member 23 has less load when separating a recoding paper P to reduce damages to a recording paper P.

Next, a first embodiment of the fixing device of the present invention is explained, referring to FIGS. 4 to 9. A fixing roller 21, a pressure roller 22 and a separation click 23 in these Figs. are the same as those in FIGS. 1 to 3, and explanations thereof are omitted.

Therefore, a tension coil spring 26 as a contact direction biasing means biasing an end 23*a* of a separation click 23 as a separation assisting member to contact the surface of a fixing roller 21, and a contact and release switching member switching contact to and release to the end 23*a* of the separation click 23 as a separation assisting member from the surface of the fixing roller 21 (contact releasing member 27, a tension coil spring 29 as a biasing means in a contact release direction and a solenoid 30) are the same as those in FIGS. 1 to 3, and their illustrations and explanations are omitted.

Figure 4:
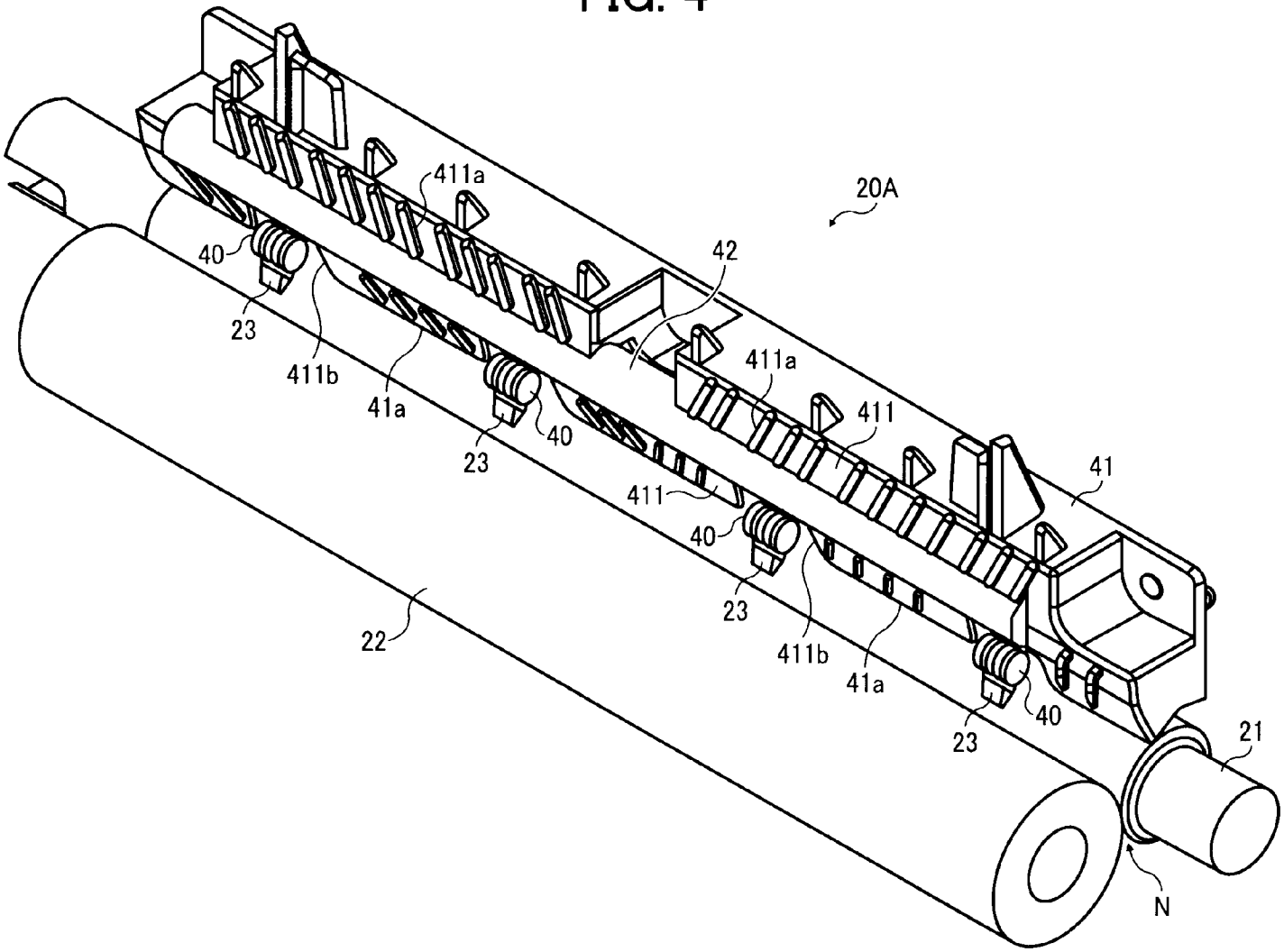
FIG. 4 is a perspective view illustrating a first embodiment of the fixing device of the present invention.
Figure 5:
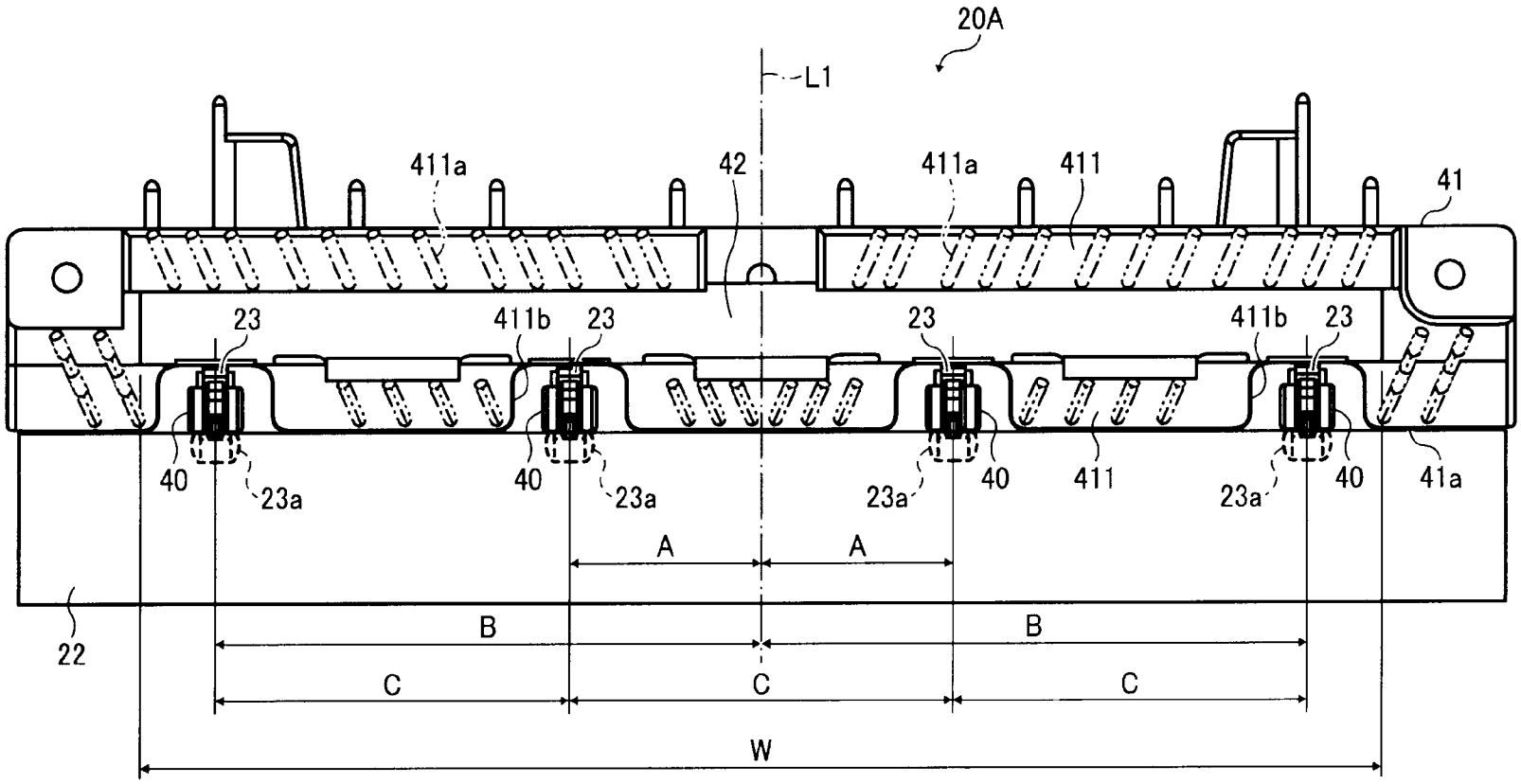
FIG. 5 is a front view illustrating the first embodiment of the fixing device of the present invention.

FIG. 4 is a perspective view of the first embodiment of the fixing device, and FIG. 5 is a front view thereof. A fixing roller 21 in FIG. 4 is behind a pressure roller 22 and not seen in FIG. 5. Projections of both ends of the fixing roller 21 in its axial direction in FIG. 4 are omitted in FIG. 5.

In a fixing device 20A, near a downstream side (above in FIGS. 4 and 5) of a nip formed by a fixing roller 21 and a pressure roller 22 in a recording paper feeding direction, four separation clicks 23 are located at equal intervals in axial directions of the fixing roller 21 and the pressure roller 22.

Near each of the separation clicks 23 at downstream side in a recording paper feeding direction, a separation click skid 40 as a first rotating member rotatably supported by an unillustrated separation click holding member. As materials for the separation click skid 40, materials having good releasability and slidability such as PFA, polyetherketone (PEK) and polyetheretherketone (PEEK) are mostly used. Alternatively, the surface of the separation click skid 40 may be coated with materials having good releasability and slidability such as PFA and TEFLON (registered trademark of DuPont).

Further, a fixing exit guide unit 41 as a fixing exit guide member guiding a paper in the shape of surrounding each of the separation clicks 23 is located at a downstream side of the fixing nip N formed by the fixing roller 21 and the pressure roller 22 in a recording paper feeding direction. The fixing exit guide unit 41 guides a recording paper having passed the fixing nip N and separated from the fixing roller 21 by each of the separation clicks 23 to a paper discharge direction.

The fixing exit guide unit 41 is made of a light and heat-resistant polyethyleneterephthalate resin (PET) including glass formable to have complicated shapes.

The fixing exit guide unit 41 is preferably located farther from the fixing nip N than the separation click 23 so as to have a space from the fixing roller 21 such that an end 41*a* close thereto (a bottom end in FIGS. 4 and 5) does not contact and damage the fixing roller 21.

When the end 41*a* of the fixing exit guide unit 41 is located closer to the fixing nip N than the separation click 23 or at the same position as that thereof, a paper enters a gap between the fixing roller 21 and the end 41*a* of the fixing exit guide unit 41 while the paper is not fully separated from the fixing roller 21 (a paper around the separation click 23 has a part therebetween still adhering to the fixing roller 21 even when separated therefrom), resulting in edge folding and jamming. In order to avoid these, the end 41*a* of the fixing exit guide unit 41 needs to be located farther from the fixing nip N than the separation click 23 so as to have a space from the fixing roller 21.

The fixing exit guide unit 41 as a fixing exit guide member is formed over whole lengths of the fixing roller 21 and the pressure roller 22, and has a paper guide surface 411 many ribs 411*a* are formed on. As FIG. 5 shows, symmetrically through a center line L1 of a paper passing area W along axial directions of the fixing roller 21 and the pressure roller 22, the ribs 411*a* are parallely formed in each right and left side inclining outward (rightward or leftward) to a paper feeding direction (above in FIG. 5).

A number of the ribs 411*a* formed on the paper guide surface 411 increase guidability and feedability of a paper, and prevents loose and wrinkles in a width direction.

A notch 411*b* is formed for each of the separation clicks 23 at the bottom end 41*a* side of the paper guide surface 411.

Further, the fixing exit guide unit 41 rotatably supports a guide roller 42 as a second rotating member at an intermediate part of the paper guide surface 411 in a paper feeding direction, i.e., downstream from the separation click skid 40 as a first rotating member.

The guide roller 42 is located over almost whole width of the paper passing area W, and is a cylindrical or a column-shaped roller having a uniform diameter over its whole length. The guide roller 42 is preferably formed of aluminum or iron coated with fluorine-containing resins having good releasability and slidability such as PFA and TEFLON (trademark).

In FIG. 5, two inner separation click 23 are symmetrically located at a distance of A from the center line L1 of the paper passing area W, and two outer separation click 23 are symmetrically located at a distance of B from the center line L1 of the paper passing area W. The separation clicks 23 are located at almost equal intervals.

The separation clicks 23 symmetrically located through the center line L1 of the paper passing area W equalize right and left deformations of a paper having passed the fixing nip to prevent a paper from folding its edge and jamming, and ensure feedability. The separation clicks 23 located at almost equal intervals are uniformly loaded when a paper is separated from the fixing roller 21, which prevents the fixing roller 21 from being damaged due to a partial load concentration.

Figure 6:
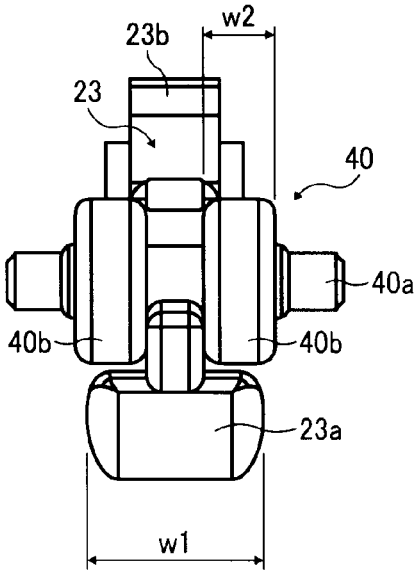
FIG. 6 is an amplified front view illustrating a separation click and a separation click skid in FIGS. 4 and 5.
Figure 7:
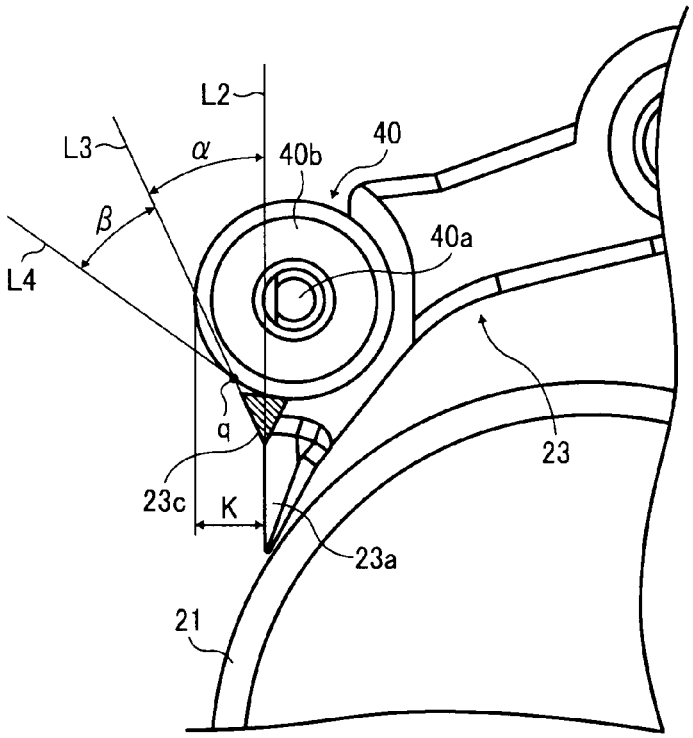
FIG. 7 is an amplified side view illustrating the separation click and the separation click skid in FIGS. 4 and 5.
Figure 8:
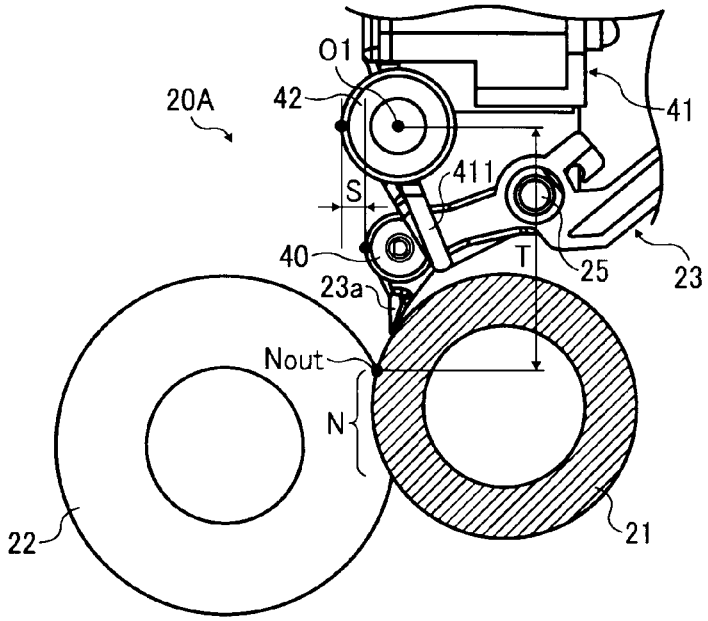
FIG. 8 is a main side view illustrating the fixing device in FIGS. 4 and 5.

The separation click 23, the separation click skid 42 and the guide roller 42 are further explained in detail, referring to FIGS. 6 to 8.

FIG. 6 is an amplified front view illustrating the separation click 23 and the separation click skid 40.

A pair of rollers 40*b* are supported and located on an axis 40*a* of the separation click skid 40 as a first rotating member so as to sandwich the separation click 23. In FIG. 6, the end 23*a* of the separation click 23 contacts the fixing roller 21 at a pressure of from 4 to 6 g and has a width w1 of from 3 to 6 mm, and the separation click skid 40 has a width w2 of 2.5 mm.

The contact pressure of the end 23*a* of the separation click 23 to the fixing roller 21 has only to be a strength needed to separate a paper from the fixing roller 21. When too strong, the surface of the fixing roller 21 wears more, resulting in glossy stripe. When too weak, a paper cannot be separated from the fixing roller 21. This is why the contact pressure is preferably from 4 to 6 g.

The end 23*a* of the separation click 23 directly contacts the fixing roller 21 at the width w1. Therefore, a damage on the surface thereof and a glossy stripe due to wear have the width w1, and which is preferably small. However, when too small, a load is concentrated on a contact point between the end 23*a* and the fixing roller 21, possibly resulting in a sharp and noticeable glossy stripe. This is why the end 23*a* of the separation click 23 preferably has a width w1 of from 3 to 6 mm, and a load on the separation click 23 is properly controlled.

FIG. 7 is an amplified side view of the separation click 23 and the separation click skid 40.

The separation click skid 40 as a first rotating member is located such that each of rollers 40*b* is partially projected by a projection amount K from an extended line L2 of an outer surface of the end 23*a* of the separation click 23. In FIG. 7, the projection amount K of the separation click skid 40 is 2 mm.

Further, the separation click 23 as a separation assisting member has a relay 23*c* relaying a recording paper from its end 23*a* to the separation click skid 40. An angle α is formed by the extended line L2 of the outer surface of the end 23*a* of the separation click 23 and an extended line L3 of an outer surface of the relay 23*c*. An angle β is formed by the extended line L3 of the outer surface of the relay 23*c* and a tangent L4 of an outer circumferential surface of the roller 40*b* intersecting the extended line L3 at a point q at the relay 23*c* side. In FIG. 7, the angle α is 23° and the angle β is 29°.

When the projection amount K of the separation click skid 40 is large, a plain paper, a thin paper (having a weight of 70 g/cm$^2$ or less) or an inelastic paper can smoothly be separated from the separation click 23 and a friction trace thereof can be prevented. However, an elastic or a thick paper (having a weight of 150 g/cm$^2$ or more) is pressed more by the separation click skid 40 and discharged, resulting in a friction trace thereof.

Compared friction traces of a thin paper with those of a thick paper, the projection amount K of the separation click skid 40 is determined to be 2 mm.

The relay 23*c* between the separation click 23 and the separation click skid 40 is formed to smoothly transfer a paper from the separation click 23 to the separation click skid 40. Without the relay 23*c*, an angle (α+β) formed by the separation click 23 and the separation click skid 40 becomes large, a paper hits the separation click skid 40, possibly resulting in jamming.

Both of the angles α and β are preferably not greater than 30° to prevent defective images and jamming.

FIG. 8 is a main side view of the fixing device 20A in FIGS. 4 and 5, and positional relationships of the fixing nip exit, the separation click skid and the guide roller in a paper feeding direction are explained. In FIG. 8, T is a distance from the fixing nip exit Nout to an axial center 01 of the guide roller 42 as a second rotating member, and S is a projection amount of the guide roller 42 to the pressure roller 22 relative to the separation click skid 40. In FIG. 8, the distance T from the fixing nip exit Nout to the axial center of the guide roller 42 is 20 mm, and the projection amount S of the guide roller 42 from the separation click skid 40 is 2 mm.

The more the projection amount S of the guide roller 42 from the separation click skid 40, the more defective images such as friction traces and glossy stripes by the separation click 23 and the separation click skid 40 can be prevented. However, when the projection amount S is large, moisture in a paper vapors after passing the fixing nip N and is likely to adhere to the projection of the guide roller 42.

The moisture vapor having adhered to the projection of the guide roller 42 drops on a paper as a water droplet, and a trace of the droplet is left on the paper after discharged. In both side printing, a water droplet changes the quality of paper and a toner is not transferred onto a backside thereof, occasionally resulting in production of deficient images.

The shorter the distance T from the fixing nip exit Nout to the axial center 01 of the guide roller 42, the more defective images such as friction traces and glossy stripes by the separation click 23 and the separation click skid 40 can be prevented. Further, the projection amount S of the guide roller 42 from the separation click skid 40 can be smaller.

Figure 9:
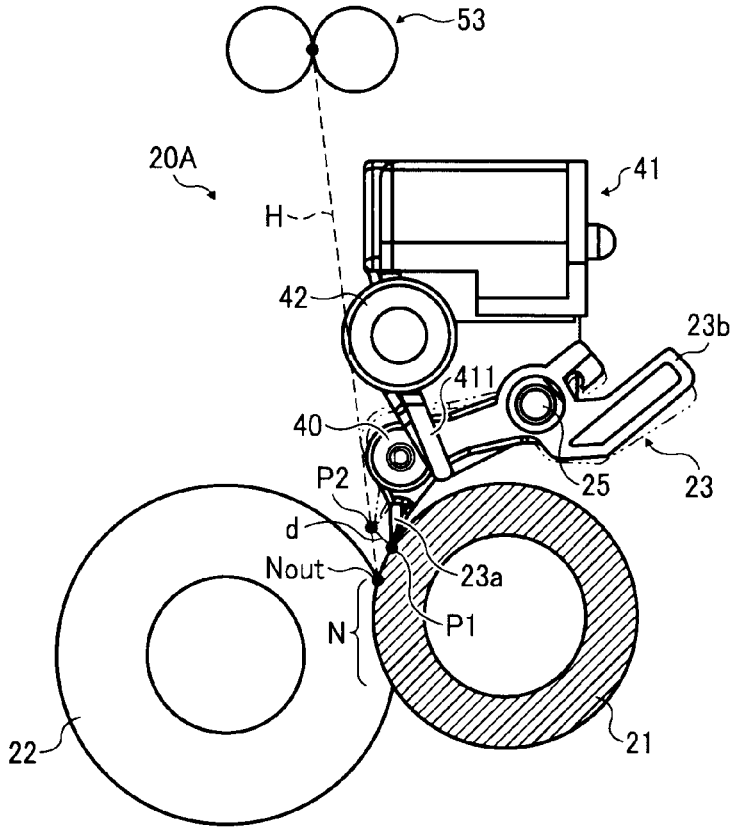
FIG. 9 is a side view for explaining a contact and separation operation of the separation click in the fixing device in FIGS. 4 and 5.

FIG. 9 is a side view for explaining a contact and separation operation of the separation click 23 in the fixing device 20A.

P1 is a position of the end 23*a* of the separation click 23 when contacting the fixing roller 21, P2 is a position of the end 23*a* of the separation click 23 when separated therefrom, and d is a distance between P1 and P2. In FIG. 9, d is 2 mm. A broken line H from the fixing nip exit Nout to a paper sandwiching point of a pair of discharged paper skids 53 is a feed route of papers.

The end of the separation click 23 is located at the fixing roller 21 side relative to the broken line H from the fixing nip exit Nout to a paper sandwiching point of the pair of discharged paper skids 53 when the separation click 23 separates to prevent problems when the separation click 23 projects toward the pressure roller 22. When the end of the separation click 23 is located at the pressure roller 22 side relative to the broken line H when the separation click 23 separates, the end of the separation click 23 projects against a paper feeding route, resulting in preventing a paper from feeding.

Even in this case, an inelastic paper deflects and a friction trace of the separation click 23 is not made. However, it possibly takes time to discharge the paper because of its unstable movement, and a paper discharge sensor does not detect passage of the paper, and which is possibly judged to be paper jam. An elastic paper such as thick papers possibly has a friction trace and a glossy stripe when the separation click 23 continues to contact the paper.

The first embodiment of the fixing device has the following features. The second and third embodiments mentioned later have the same.

A recording paper as a recording medium having passed the fixing nip N is separated from the fixing roller 21 as a fixing device by the separation clicks 23 as a separation assisting member, and transferred by the separation click skid 40 as a first rotating member located near the separation clicks 23. Then, the recording paper is guided by the paper guide surface 411 and the guide roller 42 as a second rotating member formed thereon of the fixing exit guide unit 41 as a fixing exit guide member to a paper discharging direction.

In short, after a recording paper passes the fixing nip N, it is sequentially transferred to the separation click 23, the separation click skid 40 near the separation click and the guide roller 42 of the fixing exit guide unit 41 to sequentially contact plural rotating members, i.e., the separation click skids 40 and the guide rollers 42. Therefore, contact pressures of a recording paper with the separation click 23 near the fixing nip and the separation click skid 40 can be diversified, and a toner is cooled and completely fixed on a recording paper when reaching the guide roller 42, and which does not cause defective images such as friction traces and glossy stripes.

Figure 10:
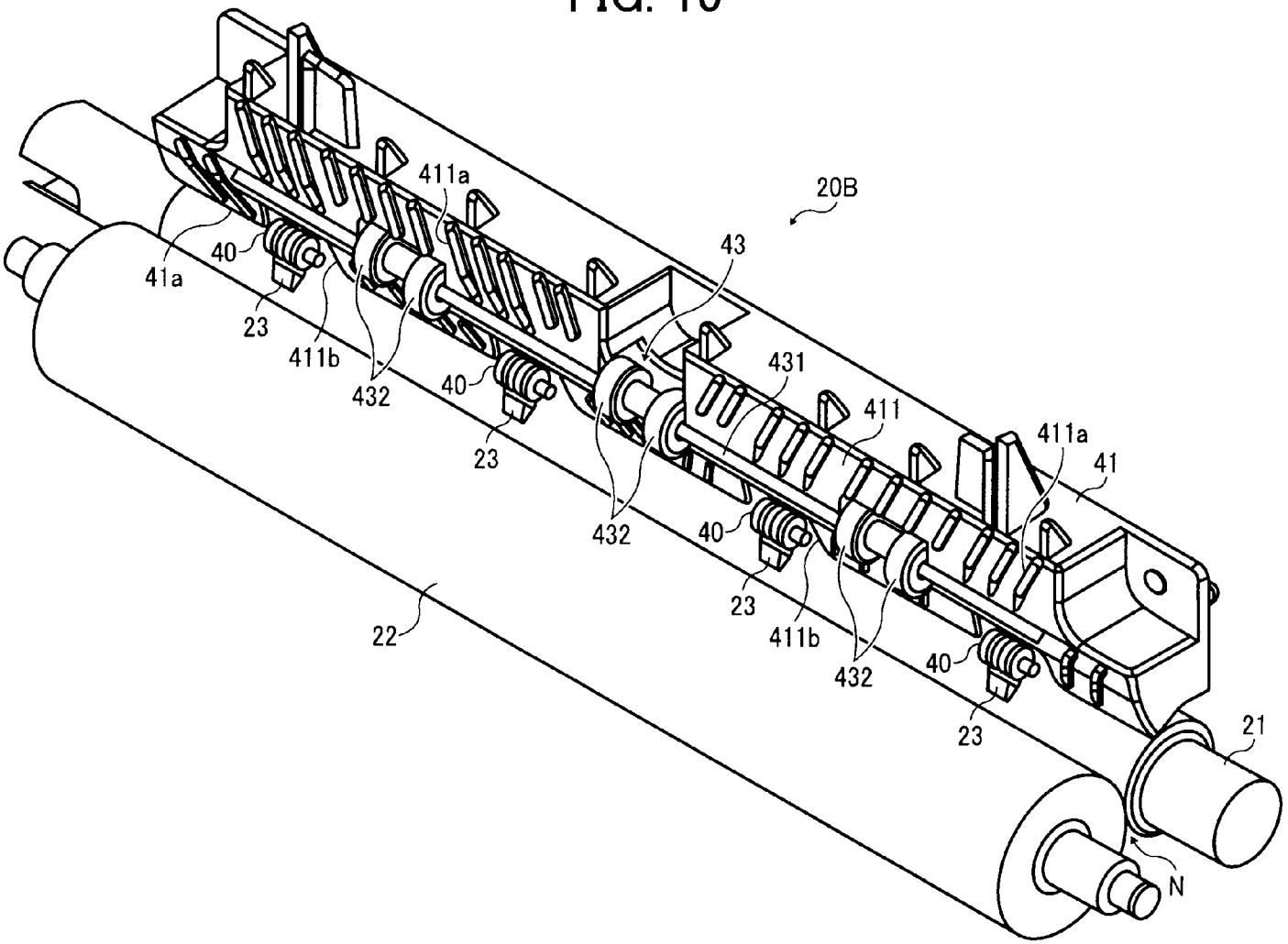
FIG. 10 is a perspective view illustrating a second embodiment of the fixing device of the present invention.
Figure 11:
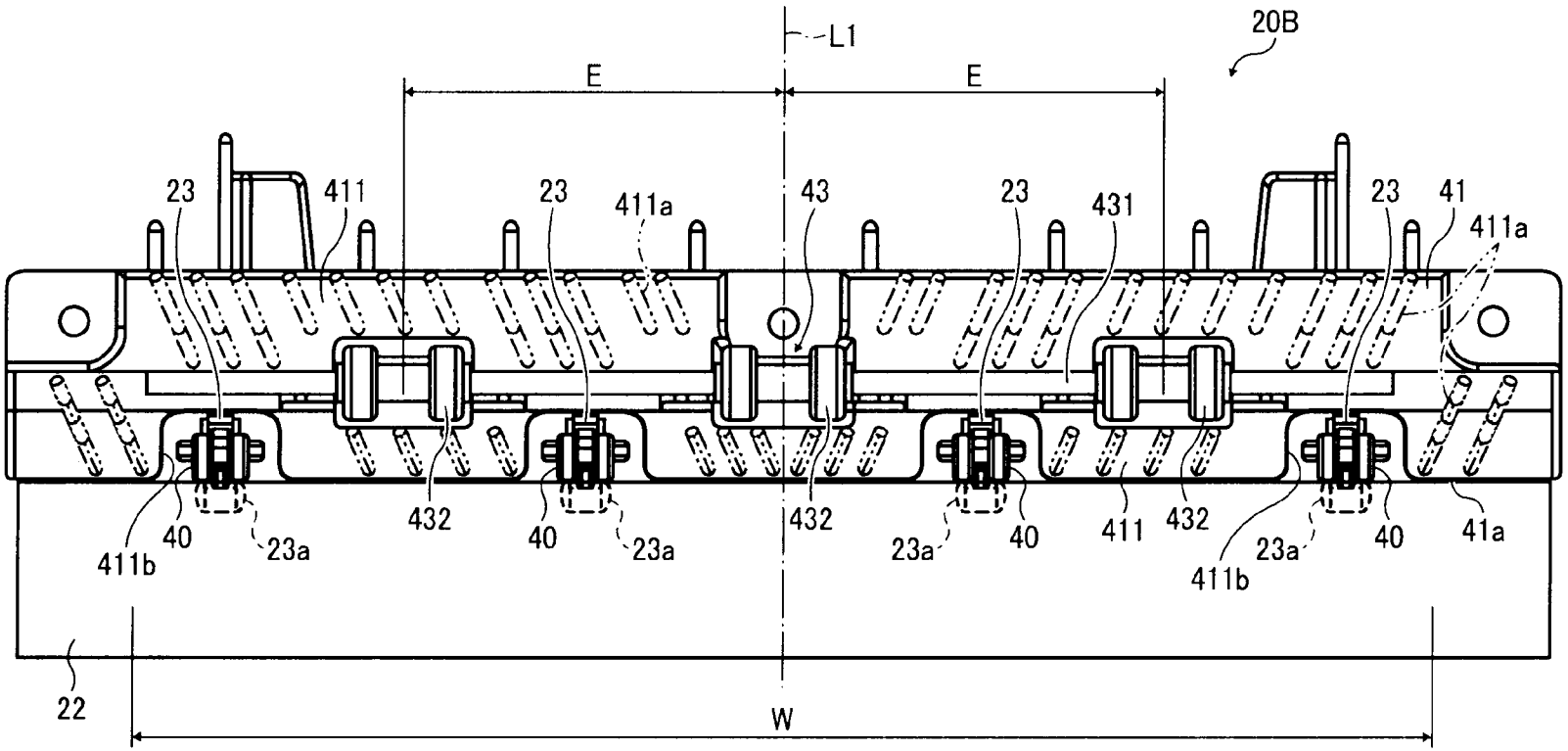
FIG. 11 is a front view illustrating the second embodiment of the fixing device of the present invention.
Figure 12:
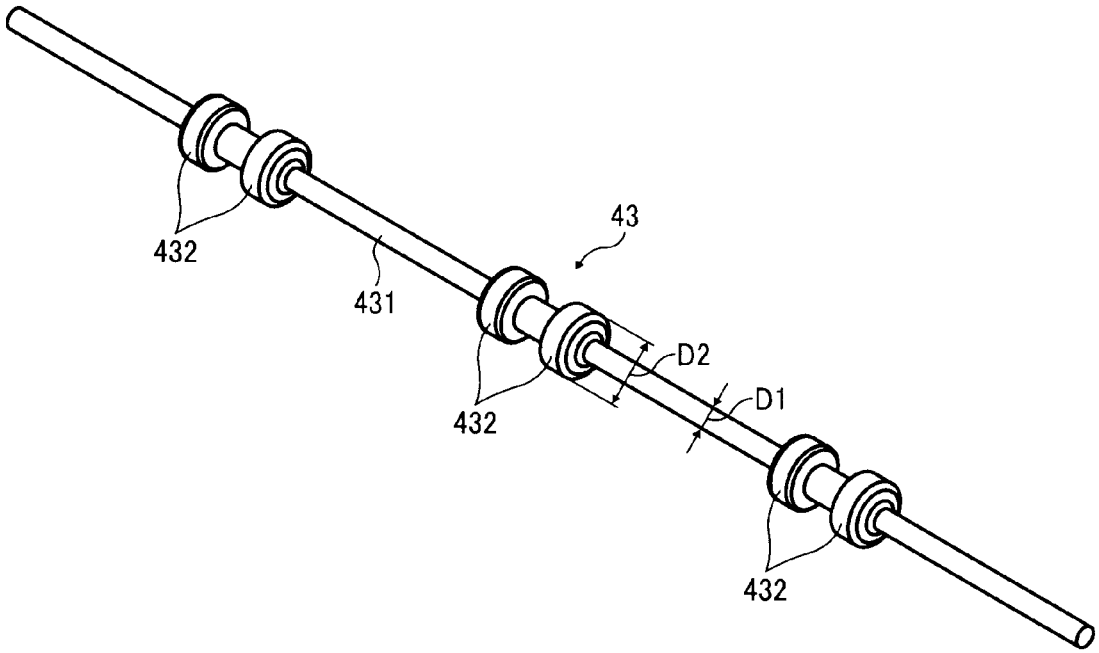
FIG. 12 is a perspective view illustrating a guide roller of the fixing device in FIG. 9.

Next, a second embodiment of the fixing device of the present invention is explained, referring to FIGS. 10 to 12.

FIG. 10 is a perspective view of the fixing device 20B, FIG. 11 is a front view thereof and FIG. 12 is a perspective view illustrating a guide roller 43 thereof.

In FIGS. 10 and 11, parts which are same as those in FIGS. 4 to 9 of the first embodiment have the same numerals and explanations thereof are omitted.

The fixing roller 21 in FIG. 10 is not seen behind the pressure roller 22 in FIG. 11. Projections of both ends of the fixing roller 21 and of the pressure roller 22 are omitted in FIG. 11.

The fixing device 20B of the second embodiment is different from the fixing device 20A of the first embodiment only in the guide roller 43. The other constitutions and operations are the same as those of the fixing device 20A.

In the fixing device 20A of the first embodiment, the guide roller 42 is a cylinder or a cylindrical roller having a same diameter over almost whole width of a paper passing area. The guide roller 43 in the fixing device 20B of the second embodiment is formed of a guide roller axis 431 having a small diameter fixed on or rotatably supported by the fixing exit guide unit 41 almost whole length of a paper passing area and three guide roller skids 432 each including a pair of rollers in a body, fixed on or rotatably supported by the guide roller axis 431 at nearly equal intervals.

As FIG. 12 shows, the guide roller axis 431 of the guide roller 43 has a diameter D1 smaller than a diameter D2 of the guide roller skids 432 (D1<D2). As materials for the guide roller skid 432, materials having good releasability and slidability such as PFA, PEK and PEEK are mostly used. The guide roller having such a configuration can make the fixing device lighter.

In the fixing device 20A of the first embodiment, the guide roller 42 projects toward the pressure roller 22 relative to the separation click skid 40 over almost whole width of the paper passing area. Therefore, a moisture vaporing from a paper having passed the fixing nip N is likely to adhere to the projection of the guide roller 42, and the moisture adheres the paper passing area over almost whole width thereof. As mentioned above, the moisture adhering to the guide roller 42 becomes a droplet leaving a trace on images.

On the other hand, in the fixing device 20B of the second embodiment, only the three pair of the guide roller skids 432 of the guide roller 43 project toward the pressure roller 22 relative to the separation click skid 40. Therefore, a moisture vapor adheres to a projection of the guide roller skids 432 but much less than the guide roller 42 in the first embodiment, and much less droplets leaving traces on images.

The guide roller 43 is located at a downstream side (upper side in FIGS. 10 to 12) in a paper feeding direction from the fixing nip N between the fixing roller 21 and the pressure roller 22 relative to the separation click skid 40. As FIG. 11 shows, one of the guide roller skids 432 is located on a center line L1 of the whole width W of the paper passing area, and each one thereof is located from the center line L1 right and left at a distance of E. i.e., totally three guide roller skids are located alternately with the separation click 23. In FIG. 11, the distance E is 58 mm.

The guide roller skid 432 and the separation click 23 are alternately located to save space and prevent friction trace of the separation click 23 and the guide member.

For example, when the guide roller skid 432 is located at a downstream side in a paper feeding direction behind the separation click 23, a space is needed such that a diameter D2 of the guide roller skid 432 does not interfere with the separation click 23, its holding members and the separation click skid 40. The larger the diameters of the separation click skid 40 and the guide roller skid 432, the longer a distance therebetween.

However, when the guide roller skid 432 and the separation click 23 are alternately located, just a distance such that the guide roller skid 432 and the guide roller axis 431 having a smaller diameter than the guide roller skid 432 do not interfere with the separation click 23, its holding members and the separation click skid 40 is needed, and the separation click skid 40 and the guide roller skid 432 can be located close to each other.

Figure 13:
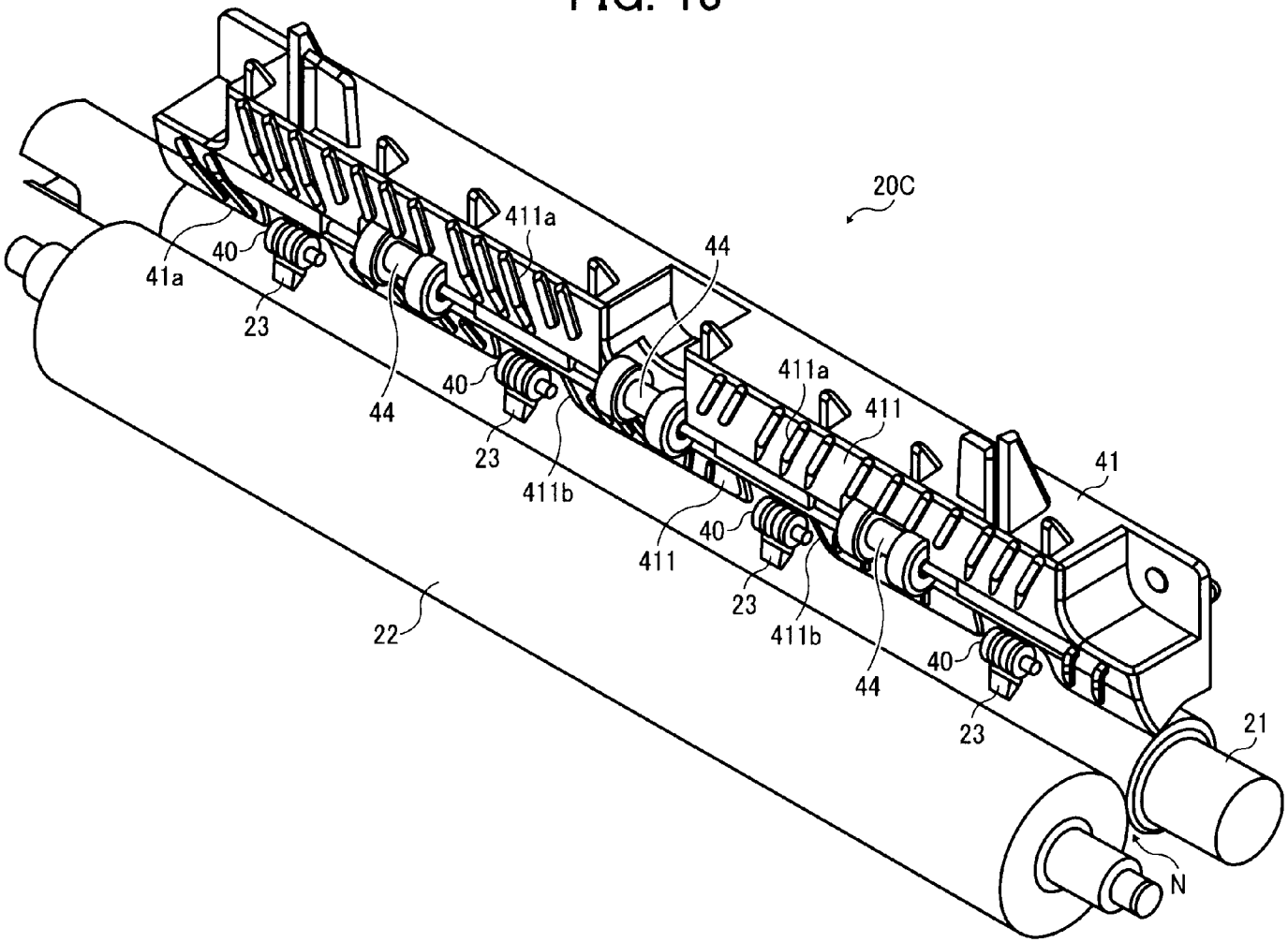
FIG. 13 is a perspective view illustrating a third embodiment of the fixing device of the present invention.
Figure 14:
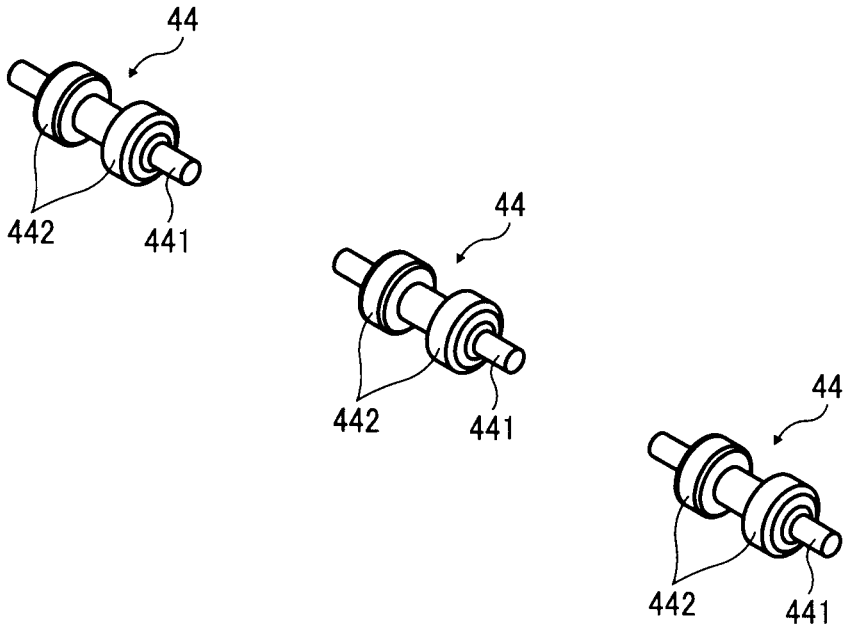

Next, a third embodiment of the fixing device of the present invention is explained, referring to FIGS. 13 and 14. FIG. 13 is a perspective view of a fixing device 20C, and FIG. 14 is a perspective view thereof. In FIGS. 13 and 14, parts which are same as those in FIGS. 4 to 9 of the first embodiment have the same numerals and explanations thereof are omitted.

The fixing device 20C of the third embodiment is different from the fixing device 20A of the first embodiment only in a guide roller 44. The other constitutions and operations are the same as those of the fixing device 20A.

In the fixing device 20A of the first embodiment, the guide roller 42 is a cylinder or a cylindrical roller having a same diameter over almost whole width of a paper passing area. In the fixing device 20C of the third embodiment, each of three guide rollers 44 is fixed on or rotatably supported by the fixing exit guide unit 41. As FIG. 14 shows, each of the guide rollers 44 is formed of a guide roller skid 442 a pair of rollers fixed on in a body and a guide roller axis 441 the guide roller skid 442 is fixed thereon or rotatably supported thereby.

The three guide rollers 44 are located equally with the three guide roller skids 432 of the guide roller 43 of the second embodiment in FIG. 12. Thus, the guide roller has less weight and the weight of the fixing device can be saved. The guide roller 44 and the separation click 23 are alternately located to save space and prevent friction trace of the separation click 23 and the guide member.

Just the short three guide rollers 44 are fitted in the fixing exit guide unit 41, which is simple and does not take time to save cost. At least the surface of the guide roller skid 442 is preferably coated with materials having good releasability and slidability such as PFA and TEFLON (trademark).

The number of the guide roller 44 is not limited to three.

The image forming apparatus of the present invention is an electrophotographic image forming apparatus including the fixing device of the present invention. As the fixing device 20 of the image forming apparatus in FIG. 1, any one of the fixing devices 20A, 20B and 20C of the first to third embodiments, respectively can be used.

Additional modifications and variations of the present invention are possible in light of the above teachings. It is therefore to be understood that within the scope of the appended claims the invention may be practiced other than as specifically described herein.

What is claimed is:

1. An image forming apparatus, comprising:

a pair of discharge rollers positioned to discharge a recording medium; and a fixing device comprising:

a rotatable fixing member;

a heat source disposed in the fixing member;

a rotatable opposing member configured to contact the fixing member to form a fixing nip through which a recording medium bearing a toner image is conveyed therebetween;

plural auxiliary separation members supported by a holding member and disposed parallel to the fixing member, the auxiliary separation members being mounted to be movable to be contactable with the fixing member and releasable therefrom, to separate the recording medium from the fixing member as the recording medium exits the fixing nip;

a contact direction biasing member configured to contact an end of the auxiliary separation members to the surface of the fixing member;

a fixing exit guide member located downstream from the fixing nip, and upstream from the discharge rollers, in a recording medium conveyance direction and configured to guide a recording medium exiting the fixing nip and separated from the fixing member by the auxiliary separation members in a discharge direction toward the discharge rollers;

a first rotating member rotatably supported by the holding member of the auxiliary separation members downstream from an end thereof in the recording medium feeding direction; and a second rotating member rotatably held by the fixing exit guide member downstream from the first rotating member in the recording medium conveyance direction, wherein the second rotating member is not provided to form a nip with another rotating member, through which nip the recording medium is conveyed toward the discharge rollers, wherein the second rotating member is held by the fixing exit guide member independently of the auxiliary separation members such that the second rotating member does not move with movement of the auxiliary separation members.

2. The image forming apparatus of claim 1, wherein the fixing exit guide member is located such that an end thereof which is close to the fixing member has a clearance therewith at a position farther than the auxiliary separation members from an exit of the fixing nip.

3. The image forming apparatus of claim 1, wherein the second rotating member is a cylinder or a cylindrical guide roller having a uniform diameter over the whole width of a recording medium passing area through which the recording medium is conveyed.

4. The image forming apparatus of claim 1, wherein the second rotating member comprises:

a guide roller shaft supported by the fixing exit guide member along a width direction of the recording medium passing area; and plural guide roller skids located on the guide roller in the width direction of a recording medium passing area.

5. The image forming apparatus of claim 4, wherein the auxiliary separation members and the guide roller skids are alternately located along the width direction of the recording medium passing area.

6. The image forming apparatus of claim 1, further comprising additional second rotating members, wherein one of the second rotating members is located at the center of the whole width of a recording medium passing area and the other second rotating members are located at both sides of the recording medium passing area in the width direction at intervals.

7. The image forming apparatus of claim 5, the plural second rotating members are positioned symmetrically about the center of the whole width of the recording medium passing area.

8. The image forming apparatus of claim 5, wherein the auxiliary separation members and the second rotating members are alternately located along the width direction of the recording medium passing area.

9. The image forming apparatus of claim 1, wherein the auxiliary separation members are located at equal intervals along an axial direction of the fixing member.

10. The image forming apparatus of claim 1, wherein the fixing member is a fixing rotor, the opposing member is a pressure rotor, and the auxiliary separation members are separation clicks.

11. The image forming apparatus of claim 10, wherein each of the separation clicks has an end having a width of 3 to 6 mm, which contacts the surface of the fixing rotor at a contact force of from 4 to 6 g.

12. The image forming apparatus of claim 1, wherein the second rotating member protrudes more toward the rotatable opposing member than the first rotating member.

13. A fixing device, comprising:

a rotatable fixing member;

a heat source disposed in the fixing member;

a rotatable opposing member configured to contact the fixing member to form a fixing nip through which a recording medium bearing a toner image is conveyed therebetween;

plural auxiliary separation members supported by a holding member and disposed parallel to the fixing member, contactable thereto and releasable therefrom, to separate the recording medium from the fixing member as the recording medium exits the fixing nip;

a contact direction biasing member configured to contact an end of the auxiliary separation members to the surface of the fixing member;

a fixing exit guide member located downstream from the fixing nip in a recording medium conveyance direction and configured to guide a recording medium exiting the fixing nip and separated from the fixing member by the auxiliary separation members to a discharge direction;

a first rotating member rotatably supported by the holding member of the auxiliary separation members downstream from an end thereof in the recording medium feeding direction; and a second rotating member rotatably held by the fixing exit guide member downstream from the first rotating member in the recording medium conveyance direction and configured to guide a recording medium guided by the fixing exit guide member in the recording medium conveyance direction while rotating, wherein the fixing member is a fixing rotor, the opposing member is a pressure rotor, and the auxiliary separation members are separation clicks, wherein the first rotating member partially projects toward the pressure rotor relative to a hypothetical extension line extending from an outer surface of the end of the separation click, and has a relay relaying a recording paper from its end to the first rotating member, wherein both of an angle ($\alpha$) formed by the extended line of the outer surface of the end of the separation click and a hypothetical extension line extending from an outer surface of the relay and an angle ($\beta$) formed by the extended line of the outer surface of the relay and a tangent of an outer circumferential surface of the first rotating member intersecting the extended line at a point (q) at the relay side are 30° or less.

14. The fixing device of claim 13, wherein the first rotating member projects toward the pressure rotor by 2 mm relative to a hypothetical extension line extending from an outer surface of the end of the separation click.

15. A fixing device, comprising:

a rotatable fixing member;

a heat source disposed in the fixing member;

a rotatable opposing member configured to contact the fixing member to form a fixing nip through which a recording medium bearing a toner image is conveyed therebetween;

plural auxiliary separation members supported by a holding member and disposed parallel to the fixing member, contactable thereto and releasable therefrom, to separate the recording medium from the fixing member as the recording medium exits the fixing nip;

a contact direction biasing member configured to contact an end of the auxiliary separation members to the surface of the fixing member;

a fixing exit guide member located downstream from the fixing nip in a recording medium conveyance direction and configured to guide a recording medium exiting the fixing nip and separated from the fixing member by the auxiliary separation members to a discharge direction;

a first rotating member rotatably supported by the holding member of the auxiliary separation members downstream from an end thereof in the recording medium feeding direction; and a second rotating member rotatably held by the fixing exit guide member downstream from the first rotating member in the recording medium conveyance direction and configured to guide a recording medium guided by the fixing exit guide member in the recording medium conveyance direction while rotating, wherein the fixing member is a fixing rotor, the opposing member is a pressure rotor, and the auxiliary separation members are separation clicks, wherein a distance (T) from an exit of the fixing nip to an axial center of the second rotating member is 20 mm, and the second rotating member projects toward the pressure rotor relative to first rotating member by 2 mm.

16. An image forming apparatus, comprising the fixing device according to claim 13.

17. An image forming apparatus, comprising the fixing device according to claim 15.

* * * * *